United States Patent [19]

Quigley et al.

[11] Patent Number: 4,879,656

[45] Date of Patent: Nov. 7, 1989

[54] ENGINE CONTROL SYSTEM WITH ADAPTIVE AIR CHARGE CONTROL

[75] Inventors: John H. Quigley, West Bloomfield; Roger K. Feller, Canton, both of Mich.

[73] Assignee: Ford Motor Company, Dearborn, Mich.

[21] Appl. No.: 112,789

[22] Filed: Oct. 26, 1987

[51] Int. Cl.[4] ..... F02M 17/00; F02B 3/00

[52] U.S. Cl. ..... 364/431.05; 364/431.04; 364/431.12; 123/417

[58] Field of Search ..... 364/431.03, 431.04, 364/431.05, 431.06, 431.07, 431.12; 123/416, 417, 339, 340

[56] References Cited

U.S. PATENT DOCUMENTS

| | | | |
|---|---|---|---|
| 3,969,614 | 7/1976 | Moyer et al. | 364/431.06 |
| 4,309,971 | 1/1982 | Chiesa et al. | 364/431.05 |
| 4,345,561 | 8/1982 | Kondo et al. | 364/431.04 |
| 4,348,727 | 9/1982 | Kobayashi et al. | 364/431.06 |
| 4,461,263 | 7/1984 | Hasegawa | 364/431.04 |
| 4,600,993 | 7/1986 | Pauwels et al. | 364/431.05 |
| 4,663,717 | 5/1987 | Kobayashi et al. | 364/431.05 |
| 4,698,765 | 10/1987 | Abe et al. | 364/431.04 |
| 4,733,357 | 3/1988 | Abe | 364/431.04 |
| 4,737,914 | 4/1988 | Abe et al. | 364/431.04 |
| 4,745,553 | 5/1988 | Raven et al. | 364/431.04 |

OTHER PUBLICATIONS

"A New Single Point Fuel Injection System with Adaptive Memory control to Meet Most Stringent Emission Standards", I Mech E 1985, C221/85 p. 69–75.

*Primary Examiner*—Parshotam S. Lall
*Assistant Examiner*—Brian M. Mattson
*Attorney, Agent, or Firm*—Peter Abolins; Clifford L. Sadler

[57] ABSTRACT

An engine control system controls the fuel charge and ignition spark timing of an operating engine as a function of stored tables based on engine speed and air charge. The air charge is determined as a function of engine throttle angle. Advantageously, the fuel delivery, spark timing, and idle speed control are adaptively corrected. The adaptive correction is based upon feedback from an exhaust gas oxygen sensor.

14 Claims, 3 Drawing Sheets

FIG.2
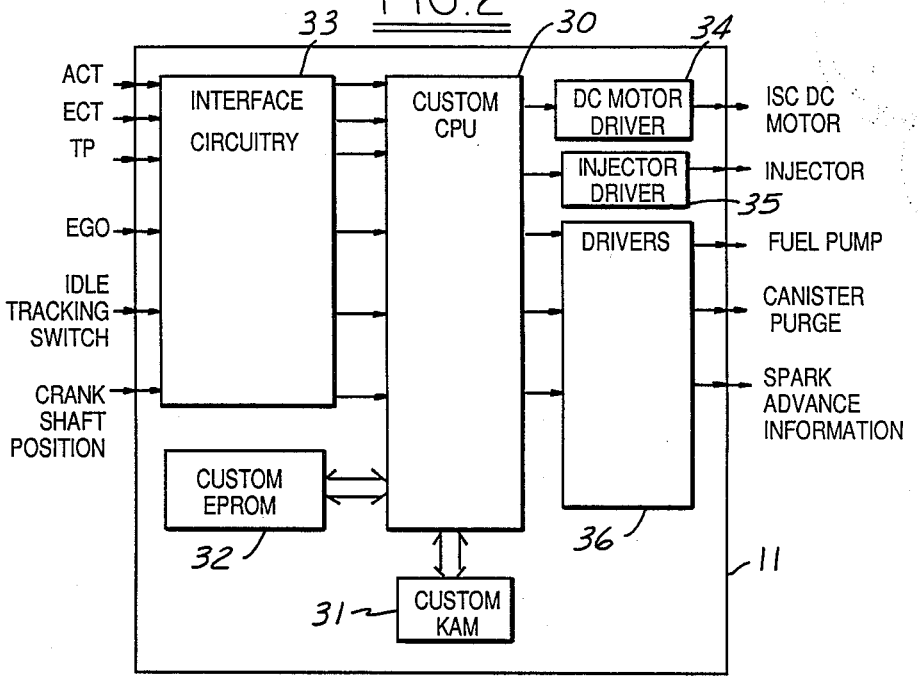
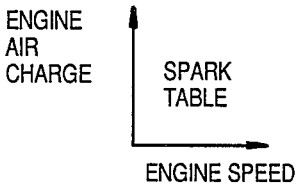
FIG.3B
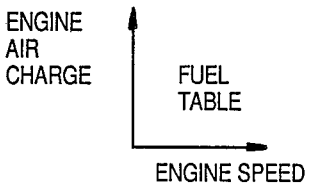
FIG.3C
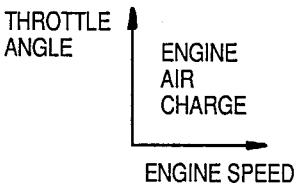
FIG.3A

ENGINE CONTROL SYSTEM WITH ADAPTIVE AIR CHARGE CONTROL

BACKGROUND OF THE INVENTION

1. Technical Field

This invention relates to an engine control system.

2. Background Art

For better engine operation and for reducing undesirable exhaust gases, it is necessary to control the air fuel ratio. To control this air fuel ratio, a determination of engine load is desirable.

Various measurements of engine load are known, but they can require relatively expensive air flow or air pressure measurement sensors. For example, vane air flow meters and mass air flow meters can be used. Further, these measurements may require a relatively complex electronic engine control system with a relatively large memory which may also add undesirably to engine control system expense.

In particular, it is known to control the fuel supply to an engine as a function of engine speed and throttle angle. Such a system is described in "A New Single Point Fuel Injection System With Adaptive Memory Control to Meet Most Stringent Emission Standards", I Mech E 1985 C221/85 p. 69-75. Nevertheless, more accurate control of engine operation is desirable taking into account more parameters without adding unnecessarily to the expense of manufacturing the engine control system.

Further, such known engine control systems may have various drawbacks such as inaccuracy or excessive cost. It would be desirable to avoid the need for pressure sensors, air flow meters and complex control modules. These are some of the problems this invention overcomes.

SUMMARY OF THE INVENTION

An engine control system in accordance with an embodiment of this invention has an air charge determination means which generates an indication of engine air charge. The engine control system further includes a table defining an engine operating parameter as a function of both engine speed and adaptive engine air charge. Examples include a spark table defining engine ignition spark timing and a fuel table defining fuel charge apPlied to the engine as a function of both engine speed and engine adaptive air charge. In each case, adaptive air charge may be defined by throttle angle. The invention provides interactive, adaptive control for spark timing, fuel injection, and idle speed control using throttle angle and engine speed as primary inputs.

In particular, certain predetermined emission standards can be achieved without the need for exhaust gas recirculation, secondary air injection into the exhaust, and mass air flow sensing or calculation. As a result, an interactive, adaptive control for spark timing, fuel injection, and idle speed control using throttle angle and engine speed as a primary input is available at a relatively low cost.

The low cost advantage in accordance with an embodiment of this invention is achieved because adaptive adjustment of stored table values permits fewer table values to be stored for a given level of engine control. Reduced requirements for storage permit smaller memories and accompanying reduced cost.

BRIEF DESCRIPTION OF THE DRAWINGS

FIG. 2 is a block diagram of a control module portion of FIG. 1, in accordance with an embodiment pf this invention;

FIG. 3A is a graphical table for air charge with respect to throttle angle and engine speed;

FIGS. 3B and 3C are graphical tables for spark advance and fuel, respectively, with respect to air charge and engine speed.

DETAILED DESCRIPTION OF THE INVENTION

In accordance with an embodiment of this invention, a speed throttle control system 10 (FIG. 1) utilizes throttle angle as a load determination instead of, for example, measured mass air flow or calculated speed density. The throttle angle is a primary input to the spark, fuel and idle speed control. Adaptive strategies are utilized to reduce component, engine and vehicle tolerances, and to provide for altitude fuel compensation without the need for additional sensors. For example, an adaptive strategy can be based on feedback as a function of air fuel ratio. Such interactive and adaptive control can compensate for engine-to-engine variability, engine wear, and engine load changes.

Figure 1:
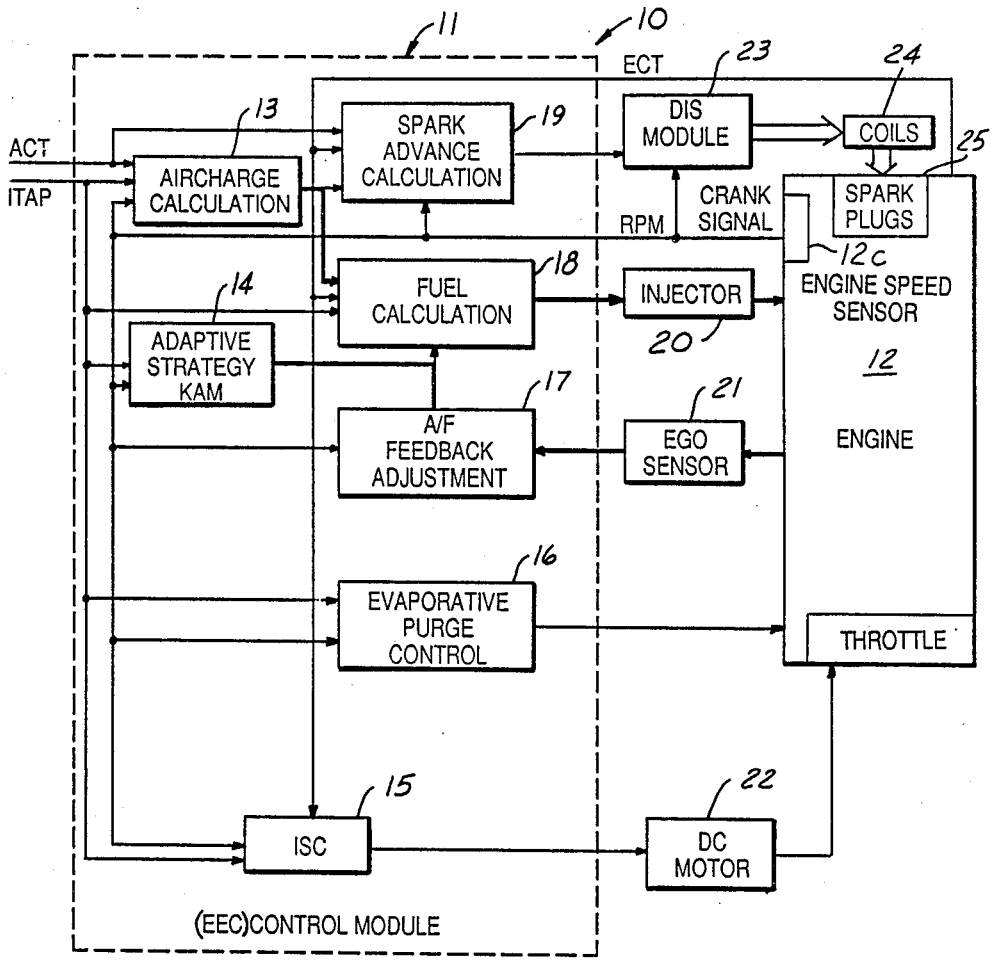
FIG. 1 is a block diagram of a speed throttle engine control system in accordance with an embodiment of this invention.

Referring to FIG. 1, speed throttle control system 10 includes an electronic engine control (EEC) module 11 coupled to an engine 12. EEC module 11 includes the following signal processing and storage: air charge calculation module 13, adaptive strategy keep alive memory module 14, idle speed control (ISC) module 15, evaporative purge control module 16, air fuel feedback adjustment module 17, fuel calculation module 18 and spark advance calculation module 19.

Fuel calculation module 18 has an output applied to a fuel injector 20 which is coupled to engine 12. An EGO (exhaust gas oxygen) sensor 21 is coupled to engine 12 and has an output coupled to the input of air fuel feedback adjustment module 17. If desired, a heated exhaust gas oxygen sensor can be used. Idle speed control module 15 applies a signal to a DC motor 22 which in turn is coupled to the fuel charging assembly of engine 12. Spark advance calculation module 19 provides an output to a distributorless ignition module 23 which applies current to ignition coils 24 which in turn are coupled to spark plugs 25 of engine 12. A signal representing engine coolant temperature (ECT) is applied from engine 12 to spark advance calculation module 19, fuel calculation module 18, and idle speed control module 15. A signal representing air charge temperature (ACT) is applied to spark advance calculation module 19 and air charge calculation module 13. A signal representing instantaneous throttle position (ITAP) is applied to air charge calculation module 13, fuel calculation module 18, adaptive strategy keep alive memory module 14, evaporative purge control module 16, and idle speed control module 15.

The adaptive feedback loop signal of speed throttle control system 10 follows a path sequentially including engine 12, exhaust gas oxygen sensor 21, air fuel feedback adjustment module 17, adaptive strategy keep alive memory module 14, air charge calculation module 13, fuel calculation module 18, fuel injector 20 and back to engine 12. As a result of this feedback path, the amount of oxygen in the engine exhaust is utilized to adaptively correct the amount of fuel injected into the engine combustion cylinders.

Referring to FIG. 2, the structure of electronic engine control module 11 is shown in block diagram. A custom central processing unit (CPU) 30 coupled by two way communication to a custom keep alive memory 31 and a custom electrically programmable read only memory (EPROM) 32. CPU 30 receives signals from interface circuitry 33, and supplies signals to a DC motor driver 34, an injector driver 35, and auxiliary drivers 36. Drivers 36 have outputs to the fuel pump, the canister purge, and spark advance information. Interface circuitry 33 receives signals supplying information regarding air charge temperature (ACT), engine coolant temperature (ECT), throttle position (TP), exhaust gas oxygen (EGO), idle tracking switch, and crankshaft position. Since the engine management system in accordance with an embodiment to this invention uses throttle position for engine load indication, the accuracy of the throttle position sensor is relatively more important than the accuracy of the other sensors. DC motor driver 34 has an output to the idle speed control DC motor. Injector driver 35 has an output to the injector. Injector 20 can be a relatively low pressure injector (15 psi) mounted in a throttle body.

Custom CPU 30 is used to store the base spark table and the base fuel table information. When this information is revised, such adaptive revision of the spark table and the fuel table is stored in custom KAM 31. Such updating of the fuel table is typically done as a function of the signal from the exhaust gas oxygen sensor 21 of FIG. 1. If desired, the spark table can be updated as a function of an oxides of nitrogen (NOX) sensor to provide a feedback signal to be used in conjunction with the updating of the spark table (NOX sensor not shown).

Speed throttle control system 10 uses three tables as indicated in FIGS. 3A, 3B and 3C. In FIG. 3A, an engine air charge table is a function of throttle angle and engine speed. When a value for air charge is determined the value is used as one axial input for each of the tables in FIGS. 3B and 3C. In FIG. 3B, the spark table is a function of engine speed on one axis and of engine air charge on the other axis. In FIG. 3C, a fuel table is a function of engine speed and engine air charge. Advantageously, the feedback loop of FIG. 1 including EGO sensor 21 is used to improve the accuracy of the throttle angle input for the air charge calculation. Such adaptive feedback correction of the throttle angle is desirable to correct vehicle to vehicle variations.

Figure 4:
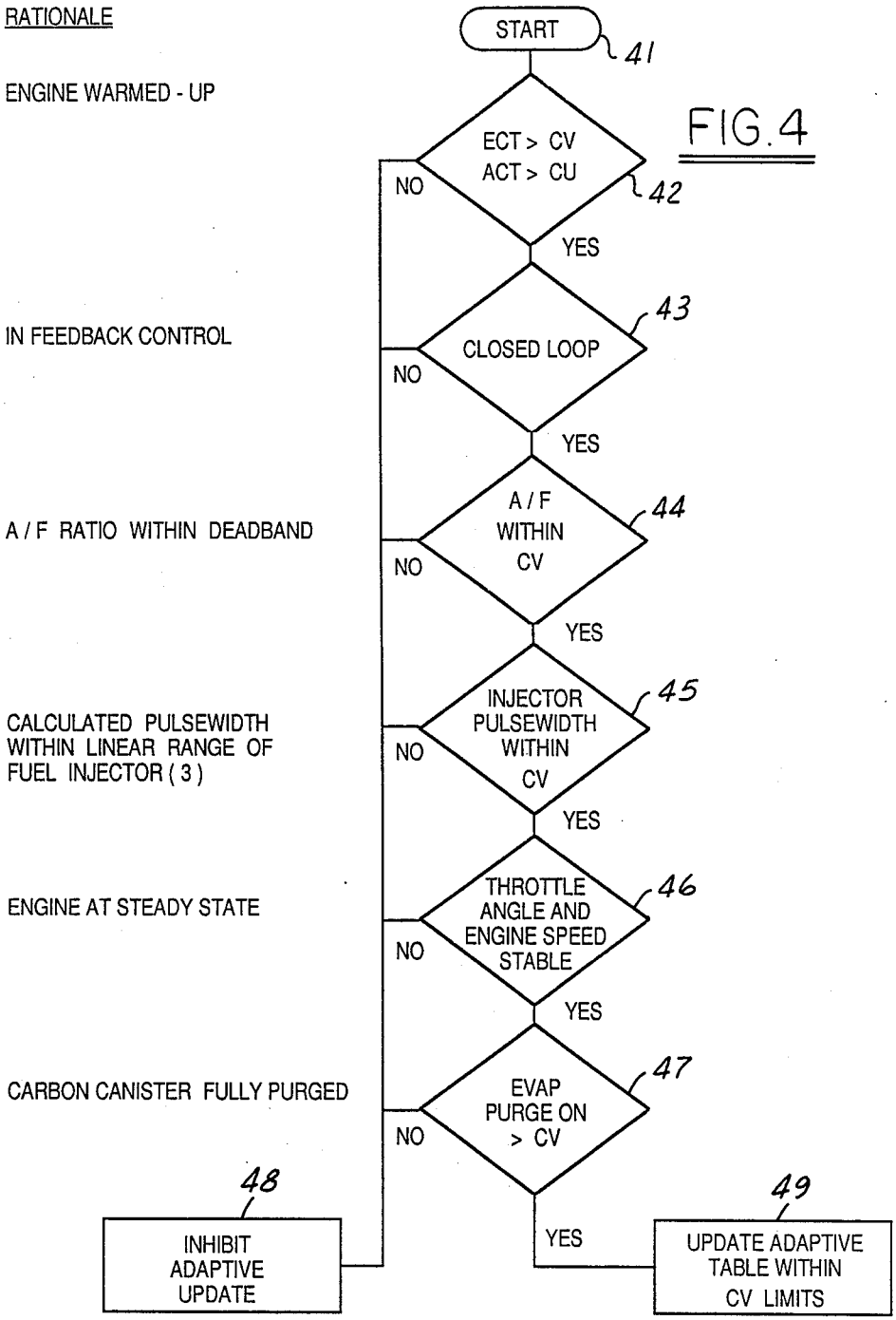
FIG. 4 is a logic flow block diagram of the operation of an engine control system in accordance with an embodiment of this invention.

Referring to FIG. 4, interactive operation of an engine control system in accordance with an embodiment of this invention begins at block 41 with START. This is the logic which occurs within (EEC) control module 11. If the logic sequence fulfills all the requirements of blocks 42 through 47, then adaptive updating occurs at block 49. On the other hand, if any of the conditions of blocks 42 through 47 are not fulfilled, adaptive updating is inhibited at block 48. Beginning this logic sequence with block 42, engine warmup is determined by checking to see if engine coolant temperature (ECT) and the air charge temperature (ACT) are each greater than some predetermined calibrated value associated with each of the parameters. If both parameters are greater, logic flow continues to block 43 where it is determined if engine operation is in closed loop feedback control. If the answer is yes, logic flow continues to block 44 where it is determined if the air fuel ratio of engine operation is within a predetermined calibrated value (CV) defined as a deadband. If operation of the air fuel ratio is within such a deadband, logic flow continues to block 45 where it is determined if the pulse width of the signal applied to the fuel injectors is within a predetermined calibrated value so as to assure that the calculated injector signal pulse width is within the linear range of the fuel injectors. If the answer is affirmative, logic flow continues to block 46 where it is determined whether the engine is at steady state by determining whether the throttle angle and engine speed are stable. If the answer is yes, at block 47 it is determined if the carbon canister evaporation purge has been fully purged so that the evaporation purge is on and is greater than a predetermined value. An affirmative answer at block 47 leads to block 49 wherein an update occurs of the adaptive table within predetermined calibration value limits.

Various modifications and variations will no doubt occur to those skilled in the art to which this invention pertains. For example, the particular control module functional structure can be varied from that disclosed herein. These and all other variations which basically rely on the teachings through which this disclosure has advanced the art are properly considered within the scope of this invention.

We claim:

1. An engine control system for controlling an engine by determining engine load based upon engine air charge comprising:

an air charge determination means for determining the amount of engine air charge and generating a signal as a function of engine throttle angle which defines engine load;

storage means for storing, as a function of received engine speed and engine air charge, a desired engine spark advance in a first table, a desired engine fuel quantity in a second table;

an engine speed sensor for sensing engine speed and generating a signal as a function of engine speed;

reference means for storing a base air charge as a function of a received engine speed;

an exhaust gas oxygen sensor coupled functionally and operationally to an exhaust of the engine for generating a feedback signal as a function of an air fuel ratio supplied to the engine;

a logic operation means coupled to said air charge determination means, said exhaust gas oxygen sensor, said storage means, said reference means and said engine speed sensor for determining the desired engine spark advance and fuel quantity by using the determined air charge to determine a position on an air charge axis of said first and second tables and using the sensed engine speed to determine a position on an engine speed axis of said first and second tables, thereby determining the desired engine spark advance and fuel quantity for engine operation, and for modifying engine air charge adaptively based upon feedback from said exhaust gas oxygen sensor to maintain stoichiometry which, in turn, results in change in the engine spark advance and fuel quantity.

2. An engine control system for controlling an engine as recited in claim 1 wherein said air charge determination means includes a throttle position sensor for sensing an angle of the engine throttle and generating a signal as a function of engine throttle angle and thus as a function of engine air charge which defines engine load.

3. An engine control system for controlling an engine as recited in claim 2 wherein said storage means stores desired engine spark timing in a first table as a function of engine speed and engine air charge.

4. An engine control system for controlling an engine as recited in claim 3 wherein said storage means stores desired engine fuel charge in a second table as a function of engine speed and engine air charge.

5. An engine control system for controlling an engine as recited in claim 4 wherein said logic operation means includes means for adapting the desired engine fuel charge as a function of the feedback signal from said exhaust gas oxygen sensor.

6. An engine control system as recited in claim 4 further comprising air/fuel ratio feedback adaptive correction means having an input coupled to receive a signal indicating engine air/fuel ratio and an output coupled to said first table for adaptive control of the desired engine spark timing stored in said first table by adaptive adjustment of air charge as determined by throttle angle value of said first table.

7. An engine control system as recited in claim 6 further comprising fuel table adaptive control means having an input coupled to receive a signal representing air/fuel ratio and an output coupled to said second table for adaptive control of calibration of desired fuel charge values stored in said second table.

8. An engine control system as recited in claim 7 wherein said logic operation means include means for fuel and spark adaptive control as a function of air charge.

9. An engine control system as recited in claim 8 further comprising means for control of evaporative purge control so as to adaptively modify the desired fuel charge.

10. An engine control system as recited in claim 9 further comprising idle speed control means coupled to said logic operation means for controlling actual idle speed as a function of the desired engine idle speed resulting in a control of fuel and spark to maintain idle stability.

11. An engine control system as recited in claim 10 further comprising means for interactive control of an adaptive strategy whereby the air charge is adaptively modified and a resulting spark is adaptively modified, and a resulting fuel engine control parameter is adaptively modified and, during idle condition, the idle speed is maintained at a predetermined RPM.

12. An engine control system as recited in claim 11 wherein said means for interactive control compensates for engine-to-engine variability, engine wear, altitude variations and engine load changes by adaptively determining a reference point for closed throttle adjustment and air charge determination.

13. An engine control system for determining engine load based upon throttle angle comprising:

a throttle position sensor for sensing an angle of an engine throttle and generating a signal as a function of engine throttle angle and thus as a function of engine air charge;

storage means for storing, as a function of received engine speed and air charge which is related to throttle angle, desired engine spark timing in a first table and desired engine fuel charge in a second table;

an engine speed sensor for sensing engine speed and generating a signal as a function of engine speed;

reference means for storing a received reference engine speed; and a logic operation means coupled functionally and operationally to said throttle position sensor, said storage means, said reference means and said engine speed sensor for determining desired engine operating parameters by using a sensed engine throttle angle to determine a position on an air charge axis of said first and second tables and using the sensed engine operating parameters by using the sensed engine throttle angle to determine a position on the air charge axis of said first and second tables and using the sensed engine speed to determine a position on an engine speed axis of said first and second tables thereby determining the desired spark timing and engine fuel change for engine operation, and adapting the fuel charge with a feedback signal generated as a function of engine exhaust gas oxygen.

14. A method for controlling engine operation including the steps of:

determining an air charge of an engine;

sensing an exhaust gas oxygen (EGO) of the engine;

adjusting the air charge as a function of an EGO signal of the engine thereby adaptively correlating engine operation and characteristics with the engine air charge;

sensing a throttle angle of the engine;

determining if an engine coolant temperature is greater than a predetermined value;

determining if engine operation is in a closed loop feedback control mode;

determining if an air fuel ratio of the engine is within a predetermined range;

determining if a pulse width of a signal applied to injectors is within a linear range of engine fuel injectors;

determining if the throttle angle of the engine is stable and engine speed is stable so that the engine is operating at a steady state; and determining if an engine carbon canister of the engine is fully purged, thereby updating an adaptive fuel charge table within calibratable limitations.

* * * * *